US009353521B2

(12) United States Patent
Waters

(10) Patent No.: US 9,353,521 B2
(45) Date of Patent: May 31, 2016

(54) CEILING-MOUNTED BAFFLE SYSTEM

(71) Applicant: Armstrong World Industries, Inc., Lancaster, PA (US)

(72) Inventor: James R. Waters, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 22 days.

(21) Appl. No.: 14/020,123

(22) Filed: Sep. 6, 2013

(65) Prior Publication Data

US 2015/0068135 A1 Mar. 12, 2015

(51) Int. Cl.

| | |
|---|---|
| ***G09F 7/18*** | (2006.01) |
| ***E04B 9/00*** | (2006.01) |
| ***E04B 9/36*** | (2006.01) |

(52) U.S. Cl.

CPC . *E04B 9/006* (2013.01); *E04B 9/00* (2013.01); *E04B 9/366* (2013.01)

(58) Field of Classification Search

CPC ..... E04B 9/345; E04B 9/006; E04B 9/366; E04B 9/00; Y10T 403/7003

USPC ..... 52/39, 506.07, 506.06

See application file for complete search history.

(56) References Cited

U.S. PATENT DOCUMENTS

| | | | | | |
|---|---|---|---|---|---|
| 213,848 | A | * | 4/1879 | Stevens | 217/32 |
| 2,437,186 | A | * | 3/1948 | Collins | 52/667 |
| 2,689,026 | A | * | 9/1954 | Zingone | 52/507 |
| 3,083,761 | A | * | 4/1963 | Attwood | 160/136 |
| 3,308,594 | A | * | 3/1967 | Ashworth | 52/507 |
| 3,511,404 | A | * | 5/1970 | Pearson | 217/31 |
| 4,005,943 | A | * | 2/1977 | Devenish et al. | 404/41 |
| 4,034,534 | A | * | 7/1977 | Taylor | 52/668 |
| 4,591,090 | A | * | 5/1986 | Collins et al. | 229/120.36 |
| 4,785,604 | A | * | 11/1988 | Johnson, Jr. | 52/668 |
| 5,241,799 | A | * | 9/1993 | Jahn | 52/506.06 |
| 5,687,526 | A | | 11/1997 | Benvenuto et al. | |
| 5,797,236 | A | * | 8/1998 | Posey et al. | 52/664 |

(Continued)

FOREIGN PATENT DOCUMENTS

| | | |
|---|---|---|
| DE | 7737740 U1 | 4/1978 |
| EP | 2546430 | 1/2013 |

(Continued)

OTHER PUBLICATIONS

International Search Report/Written Opinion for corresponding International Application No. PCT/US2014/51795, mailed Nov. 24, 2014.

*Primary Examiner* — Basil Katcheves

(74) *Attorney, Agent, or Firm* — Craig M. Sterner

(57) ABSTRACT

A ceiling-mounting baffle system including vertical panels. In one embodiment, the system includes a suspension bar mountable from a ceiling or other overhead structure and a vertical panel mountable to the suspension bar. The suspension bar includes a plurality of mounting segments spaced axially along the bar. To mount the panels to the suspension bar, the panel includes a hook element which may be disposed proximate to a top of the panel. The hook is configured to detachably engage a mounting segment to secure the panel to the suspension bar. In one embodiment, the hook element is associated with a recurved mounting slot integrally formed in the panel which receives the mounting segment of the suspension bar. The mounting segment is movable through the slot to hook the panel to the suspension bar.

17 Claims, 10 Drawing Sheets

(56) References Cited

U.S. PATENT DOCUMENTS

| | | | | |
|---|---|---|---|---|
| 5,845,454 | A | 12/1998 | Malizia | |
| 6,054,091 | A | 4/2000 | Miller et al. | |
| 6,209,151 | B1 | 4/2001 | Schwimmer | |
| 6,321,499 | B1 * | 11/2001 | Chuang | 52/480 |
| 8,336,266 | B2 | 12/2012 | Scherrer | |
| 8,596,008 | B2 * | 12/2013 | Waters et al. | 52/506.06 |
| 2009/0277117 | A1 | 11/2009 | Platt | |
| 2010/0095627 | A1 | 4/2010 | Meres et al. | |
| 2012/0074275 | A1 | 3/2012 | Chang et al. | |

FOREIGN PATENT DOCUMENTS

| | | |
|---|---|---|
| WO | 0063507 | 10/2000 |
| WO | 2010000039 | 1/2010 |

* cited by examiner

CEILING-MOUNTED BAFFLE SYSTEM

FIELD OF THE INVENTION

The present invention relates to ceiling-mounted baffle systems, and more particularly to a mounting system and related method for attaching vertical panels or panels to suspended supports of a baffle system.

BACKGROUND OF THE INVENTION

Ceiling-mounted suspended baffle systems are sometimes used in commercial or institutional buildings for various architectural, aesthetic, and acoustical reasons. The baffle systems generally include a plurality of horizontal supports which are suspended or hung from a ceiling or other overhead structure. Vertically extending panels attached to the supports form the elements of the baffle system generally seen by the building occupants. Accordingly, variations in the appearance of the vertical panels include enumerable types of materials, sizes, shapes (e.g. straight, curved, and combinations thereof), surface textures, and colors.

The vertical panels are generally mounted to the suspended horizontal supports with bracket or clips sometimes requiring the use of tools. This adds to the complexity and cost of the baffle system installation and may detract from aesthetic appearance.

A baffle system with mechanically simpler panel mounting and improved aesthetic appearance is desired.

SUMMARY OF THE INVENTION

The present invention provides a ceiling-mounted suspended baffle system in which individual vertical panels may be detachably mounted to suspension bars of the baffle system in a mechanically simple manner with improved aesthetics. In one embodiment, the panels and suspension bars are mutually configured to allow direct attachment of the panels to the suspension bars thereby obviating the need for additional mounting brackets or clips for this purpose.

According to one embodiment, a ceiling-mounting vertical baffle system includes a longitudinally-extending suspension bar mountable from a ceiling, the suspension bar including a plurality of mounting segments spaced axially apart along a length of the suspension bar, and a vertical panel mountable to the suspension bar, the panel including an upper hook element disposed proximate to a top of the panel. The hook element is configured to detachably engage a mounting segment of the suspension bar to secure the panel to the suspension bar. In an embodiment, the hook element comprises a locking projection formed as an integral unitary part of the panel and extending downwardly from the top of the panel. In another embodiment, a mounting slot is formed integrally in the panel and cooperates with the hook element to secure the panel to the suspension bar.

According to another embodiment, a ceiling-mounted baffle system includes a plurality of longitudinally-extending suspension bars mountable from a ceiling, each suspension bar including a plurality of grooves or slots defining mounting segments spaced axially apart along a length of the suspension bar, and a plurality of vertical panels mountable to the suspension bar, each panel including a recurving-shaped mounting slot configured to receive a mounting segment of one suspension bar. Each panel is mounted to a suspension bar by moving a mounting segment in opposing vertical directions within different portions of the mounting slot to secure the panel to the suspension bar.

A method for mounting a vertical panel in a ceiling-mounted baffle system is provided. In one embodiment, the method includes steps of: providing a suspension bar mountable from a ceiling; vertically aligning an entrance portion of a recurving-shaped mounting slot formed in a vertical panel with a mounting segment on the suspension bar; vertically inserting the mounting segment into the entrance portion of the slot by raising the panel; vertically sliding the mounting segment downwards in the entrance portion of the slot by continuing to raise the panel; horizontally sliding the mounting segment across the slot to an end portion of the slot by laterally moving the panel; vertically sliding the mounting segment upwards in the end portion of the slot by lowering the panel; and engaging a stop surface in the end portion of the slot with the mounting segment, wherein the panel is mounted to the suspension bar. In one embodiment, the vertically inserting step includes inserting the mounting segment of the suspension bar through a top of the panel open to the entrance portion of the slot. In one embodiment, the slot is generally J-shaped.

BRIEF DESCRIPTION OF THE DRAWINGS

The features of the exemplary embodiments of the present invention will be described with reference to the following drawings, where like elements are labeled similarly, and in which.

Figure 1:
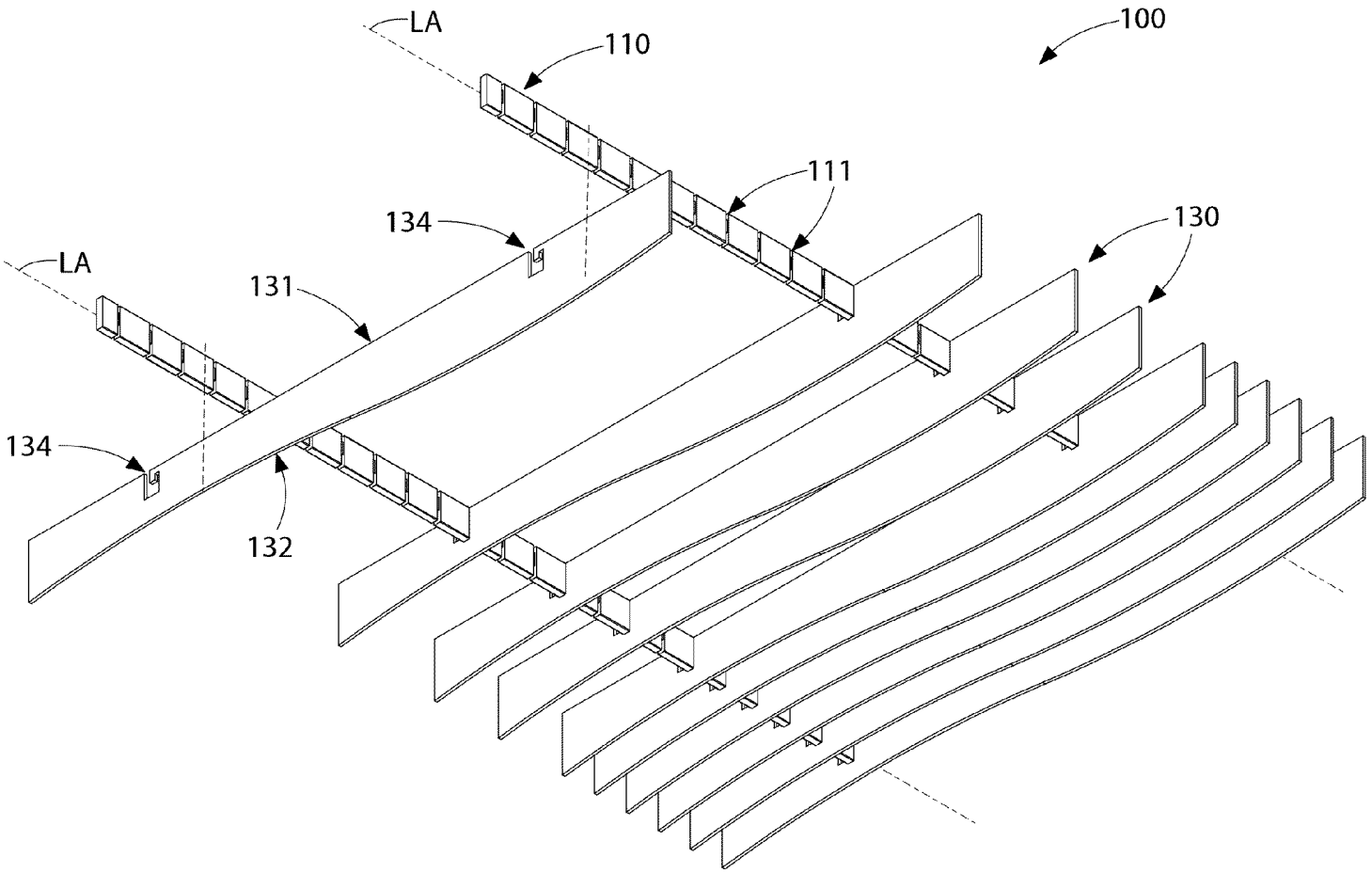
FIG. 1 is a partially exploded perspective view of a ceiling-mounted baffle system according to the present disclosure.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE EMBODIMENTS

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

FIG. 1 depicts a ceiling mounted baffle system 100 according to one embodiment of the present disclosure. The baffle system 100 includes a plurality of longitudinally-extending elongated suspension bars 110 and a plurality of vertically-oriented panels 130 configured for mounting to the bars. Suspension bars 110 are horizontally oriented and have a length L1 (FIG. 2) which defines a longitudinal axis LA. The suspension bars 110 may be supported from and suspended below a ceiling or similar overhead support structure (e.g. beam, deck, etc.) by any suitable support elements, including without limitation wires, cables, hangers, struts, etc.

Figure 2:
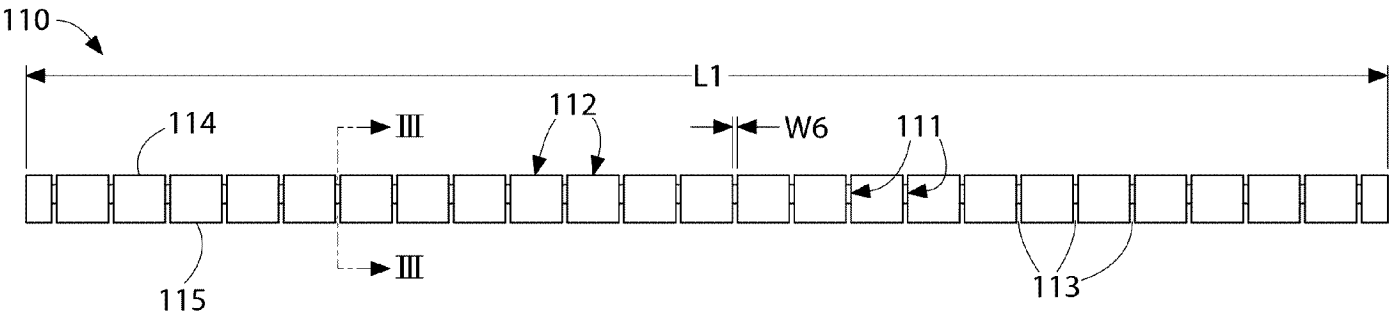
FIG. 2 is a side elevation view of a suspension bar of the baffle system
Figure 3:
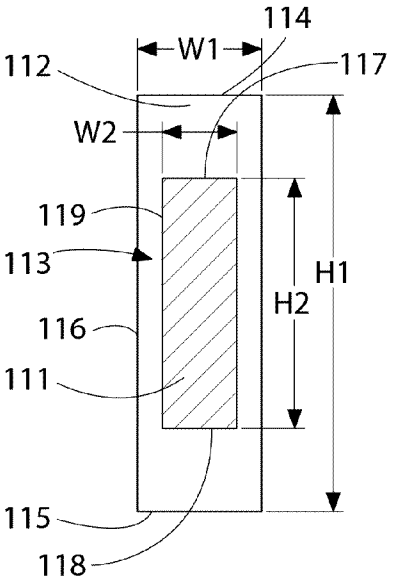
FIG. 3 is a transverse cross-sectional view of the suspension bar taken along line III-III in FIG. 2.
Figure 4:
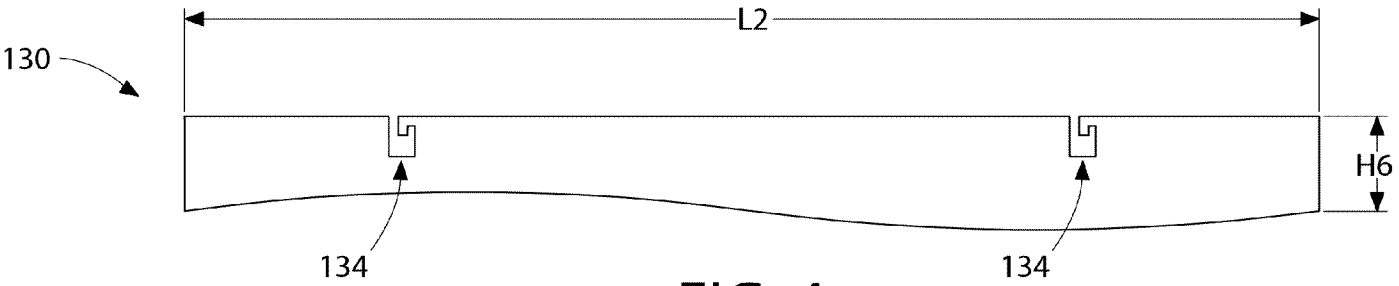
FIG. 4 is a side elevation view of a panel of the baffle system showing one embodiment of a hook element for attaching the panel to the bar.

FIGS. 2 and 3 depict side elevation and cross-sectional views of a suspension bar 110, respectively. Each suspension bar 110 may include a plurality mounting segments 111 spaced axially along the length of the bar which are configured for securing a panel 130. Each of the mounting segments 111 are therefore generally interspersed between main sections 112 of the suspension bar 110. The mounting segments 111 may be spaced at even or uneven intervals along the length L1 of the suspension bar 110. Mounting segments 111 may be formed as integral unitary structural part of the suspension bar 110 or as individual units connected between adjacent main sections 112 by any suitable means including without limitation fasteners, welding, brazing, adhesive bonding, interference fit, etc.

In one embodiment, mounting segments 111 may have a reduced profile (in transverse cross-section) in contrast to the remaining main sections 112 of the suspension bar 110 having a full profile (in transverse cross-section). The reduced profile of the mounting segments 111 facilitates attaching and securing a panel 130 to the suspension bar (best shown in FIG. 3), as further described herein. Accordingly, in various embodiments, mounting segments 111 may have a width W2 which is less than width W1 of the main section 112. Mounting segment 111 may also have a height H2 which is less than height H1 of the main section 112.

Figure 5:
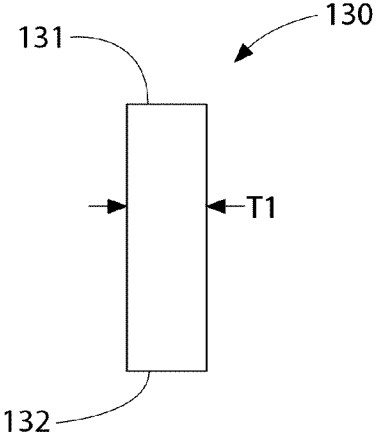
FIG. 5 is an end view thereof.

The suspension bar 110, defined by main sections 112, has a top 114, bottom 115, and opposing lateral sides 116. Similarly, mounting segments 111 may include a top 117, bottom 118, and opposing lateral sides 119 (see, e.g. FIG. 3). In various embodiments, the differences in the heights H1, H2 and/or width W1, W2 between the mounting segments 111 and main sections 112 define peripheral grooves 113 in the suspension bars 110 at the mounting segments which are configured to receive a portion of panel 130. Accordingly, with reference to FIGS. 1, 2, and 5, the grooves 113 have a width W6 sized slightly larger than the thickness T1 of the panels 130 to receive the panel portion, but not so unduly wide as to permit excessive longitudinal twisting or wobbling of the panels 130 when mounted to the suspension bars 110 to provide stable panel 130 installation. The grooves 113 may be disposed in the top 114, bottom 115, and/or lateral sides 116 of the main sections of the suspension bars 110. The grooves 113 may be oriented perpendicular to the longitudinal axis LA of the suspension bars 110 in one embodiment.

Figure 10:
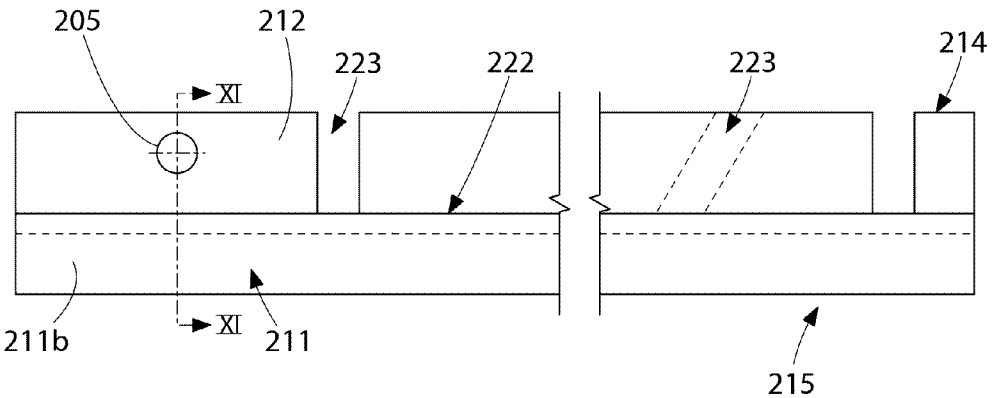
FIG. 10 is an enlarged detail of a portion X of the suspension bar of FIG. 9.

In other possible embodiments, grooves 113 may be slanted and oriented at an angle between 0 and 90 degrees to the longitudinal axis LA of the suspension bars 110 in arrangements of baffle systems 100 where the panels 130 are desired to be oriented in a slanted configuration when mounted to the suspension bar 110 (similar to the dashed slot 223 in concept as shown in FIG. 10). In some arrangements, a combination of vertically straight and slanted/angled grooves 113 may be provided on a single suspension bar 110.

In various embodiments, the mounting segments 111 may be approximately centered on the face of the main sections (see, e.g. FIG. 8A), or positioned closer to the top 114, bottom 115 or either side 116 of the main sections 112 depending on where the panel 130 is intended to be located with respect to the suspension bar 110 when fully mounted.

Mounting segment 111 may have any suitable transverse cross-sectional shape, including without limitation polygonal, rectilinear polygonal (e.g. square, rectangular, etc.) circular, ellipsoidal or other. In certain embodiments, square or rectangular configurations may be desirable for mounting segment 111 to assist with stabilizing the panel 130 on the suspension bar 110, as further described herein. Main section 112 may also have any suitable transverse cross-sectional shape, including without limitation polygonal, rectilinear polygonal, circular, ellipsoidal or other. It will be appreciated that the cross-sectional shape of the mounting segments 111 and main sections 112 may be the same or different. In one embodiment, the main sections 112 may have a rectangular cross-sectional shape.

Suspension bars 110 may be made of any suitable material including without limitation wood, metal, polymer, fiberglass, graphite composites, and combinations thereof. In one embodiment, a light-weight metal such as aluminum may be used to provide strength and deflection resistance when loaded with the weight of the panels 130. Any suitable surface finish, texture, pattern, colors, and combinations thereof may be used.

Referring to FIGS. 1, 4, 6, and 7, panels 130 when mounted extend both laterally/horizontally (transverse to the longitudinal axis LA of suspension bars 110) and vertically. In one embodiment, at least two suspension bars 110 may be used to mount each panel 130 which spans laterally between the bars. More suspension bars 110 than two may be desirable depending on the length and/or weight of each panel 130 to provide proper support. The panels 130 are oriented generally vertically and perpendicular to the longitudinal axis LA of the suspension bars 110 in some embodiments as shown when fully mounted. In other possible embodiments contemplated, panels 130 may be oriented at an angle greater than 0 degrees and less than 90 degrees by orienting grooves 113 at an angle to the longitudinal axis LA of the suspension bars 110 to form a slanted panel 130 arrangement.

Panels 130 include a top 131, bottom 132, opposing lateral sides 133, and opposing ends 136. In one embodiment, the panels 130 may be elongated and have an axial horizontal length L2 substantially larger than the height H6 and/or lateral thickness of each panel 130. The thickness of panel 130 may be generally smaller than the height H6. Panels 130 may have any desired configuration or shape, size, and be made of any suitable material. In some exemplary embodiments, without limitation, panels 130 may be variously made of wood, metal (e.g. aluminum), polymer, fiberglass, graphite composites, and combinations thereof.

According to one aspect of the invention, a mounting system is provided for detachably mounting the panels 130 to the suspension bars 110. The mounting system may be comprised of a combination of the reduced profile mounting segments 111 disposed on each suspension bar 110 which are each configured and arranged to detachably engage mutually arranged and configured upper hook elements 134 disposed proximate to the tops 131 of the panels 130 (see, e.g. FIGS. 4, 6, and 7). In one embodiment, the upper hook elements 134 may be formed by recurving-shaped mounting slots 140 which define a locking projection 145 extending downwardly from the top 131 of the panel 130. In one embodiment, the mounting slots 140 may be integrally formed in each panel 130. The mounting slots 140 may be formed, for example without limitation, by removing a portion of the panel 130 body such as by cutting, milling, routing, machining, forming during fabrication or molding, or other methods. According, in this embodiment the slots are disposed inside the peripheral edges 135 of the panels 130 and thereby do not increase the height H6 of the panel 130. The mounting slots 140 are configured and dimensioned to receive the mounting segments 111 for movement therein to detachably mount the panels 130 to the suspension bars 110, as further described herein. In one embodiment, mounting slots 140 may be disposed proximate to and have a portion which intersects the tops 131 of the panels 130.

Figure 6:
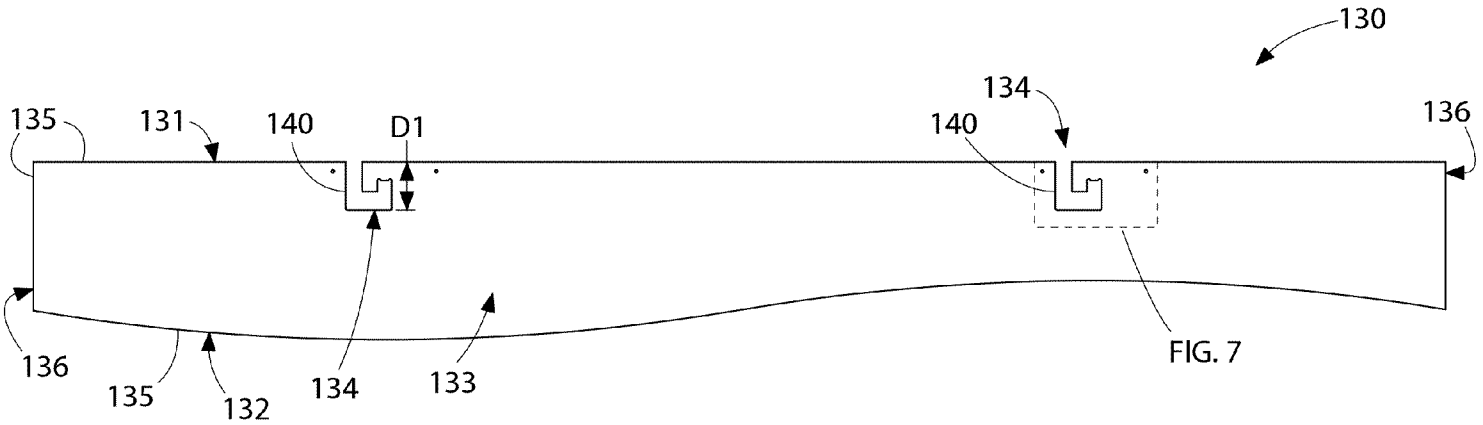
FIG. 6 is a slightly enlarged side elevation view of the panel showing a second embodiment of a hook element for attaching the panel to the bar.
Figure 7:
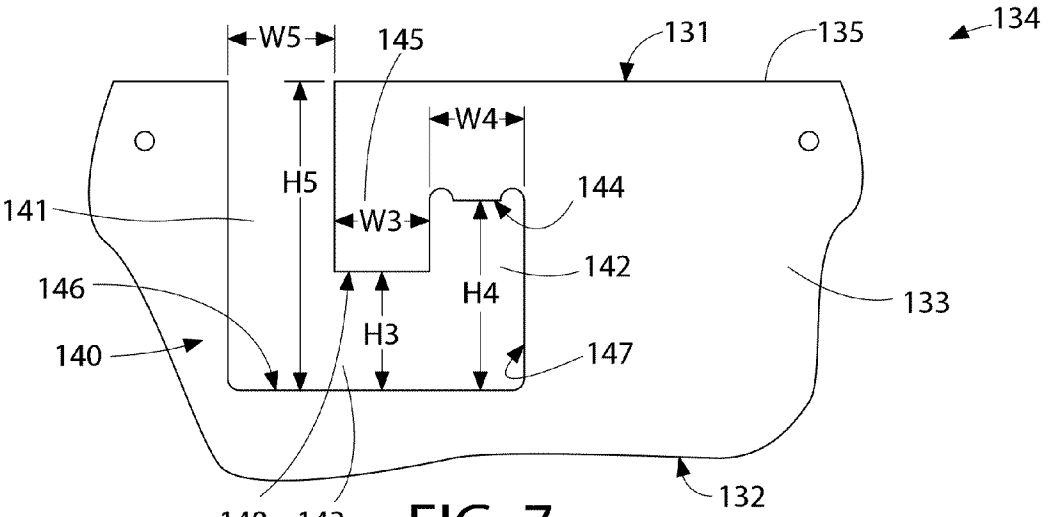
FIG. 7 is an enlarged detail of the hook element taken from FIG. 6.

Referring to FIGS. 6 and 7, each mounting slot 140 has a recurved shape in one exemplary embodiment including a vertical open entrance portion 141, a vertical closed end portion 142 spaced horizontally apart from the entrance portion, and a horizontal intermediate portion 143 communicating with and laterally connecting the entrance and end portions. Entrance portion 141 is upwardly open and penetrates the top 131 of the panel 130. End portion 142 is closed at top defining a stop surface 144 for mounting segment 111 and closed terminal end of the recurved slot 140. The end portion 142 therefore bends upwards back towards but does not penetrate top 131 of the panel 130. In one embodiment, the stop surface 144 may be substantially flat.

Mounting slot 140 further defines a bottom surface 146 which facilitates mounting the panel 130 on the suspension bar 110, as further described herein.

In one embodiment, mounting slot 140 may have a polygonal rectilinear shape such as the generally J-shaped slot shown in the present embodiment. Other suitable configurations are possible for mounting slot 140 including other polygonal shapes.

With continuing reference to FIG. 7, intermediate portion 143 of mounting slot 140 may have width W3 which is approximately the same as widths W4 and W5 of entrance and end portions 141, 142 and allows the mounting segment 111 to be slid or moved laterally across the mounting slot 140. In other variations, width W3 may be larger than width W4 and/or W5. In one embodiment, width W5 may be wider than width W4 to allow easy insertion of mounting segment 111 into mounting slot 140.

The entrance and end portions 141, 142 of mounting slot 140 may be vertically elongated in one embodiment (see FIG. 7). Accordingly, the intermediate portion 143 of mounting slot 140 may further have a height which is less than heights H4 and H5 of entrance and end portions 141, 142. Height H5 of entrance portion 141 may be greater than height H4 of end portion 142 which does not penetrate the top of panel 130.

The differences in heights and widths of the entrance, intermediate, and end portions of the mounting slot 140 define the downwardly extending locking projection 145 between the entrance and end portions. The locking projection 145 may functionally be considered as an integral hook which is a unitary element of the panel 130 which acts to secure the panel 130 to the suspension bar 110 and prevent further lateral movement of the panel 130 with respect to the suspension bar. The locking projection 145 has a bottom edge 148 which is therefore located below stop surface 144 at the closed top end of mounting slot end portion 142 to provide this functionality.

An exemplary method for mounting a vertical panel 130 in a ceiling baffle system 100 will now be described with reference to FIGS. 8A-D. These figures show sequential installation steps of the method.

Figure 8A:
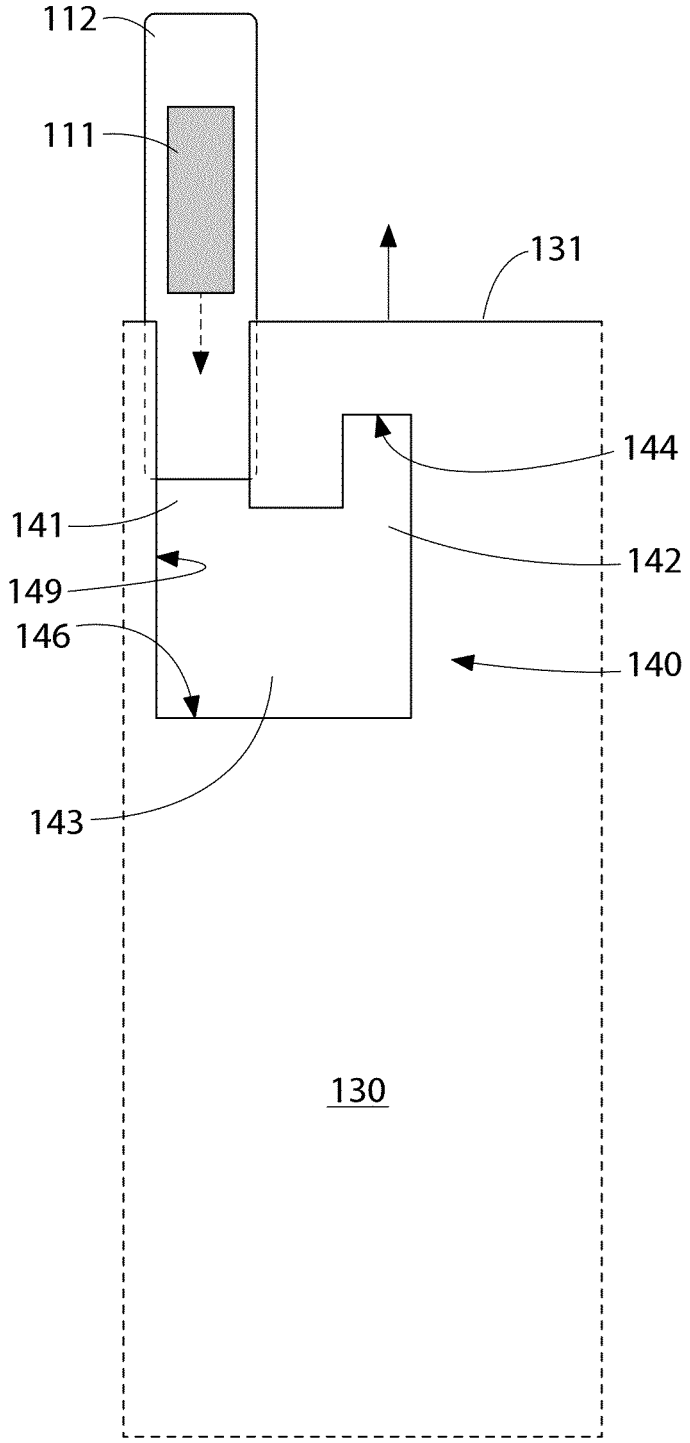
FIGS. 8A-8D are transverse cross-sectional views of the suspension bar showing sequential steps in a process for mounting a panel on the suspension bar using the hook element.

Referring to FIG. 8A, panel 130 is first located proximate to and below a suspension bar 110, which in some embodiments may be already mounted and suspended from a ceiling to essentially fix the height of the suspension bar. Entrance portion 141 of the mounting slot 140 is then vertically aligned both laterally and longitudinally with one of the mounting segments 111 of the suspension bar as shown. In one embodiment, the width W5 of entrance portion 141 is at least slightly larger than the width W2 of the mounting segment 111 (see also FIG. 3) to allow the mounting section to vertically inserted through the top opening of the entrance portion and moved downwards into the slot.

Figure 8B:
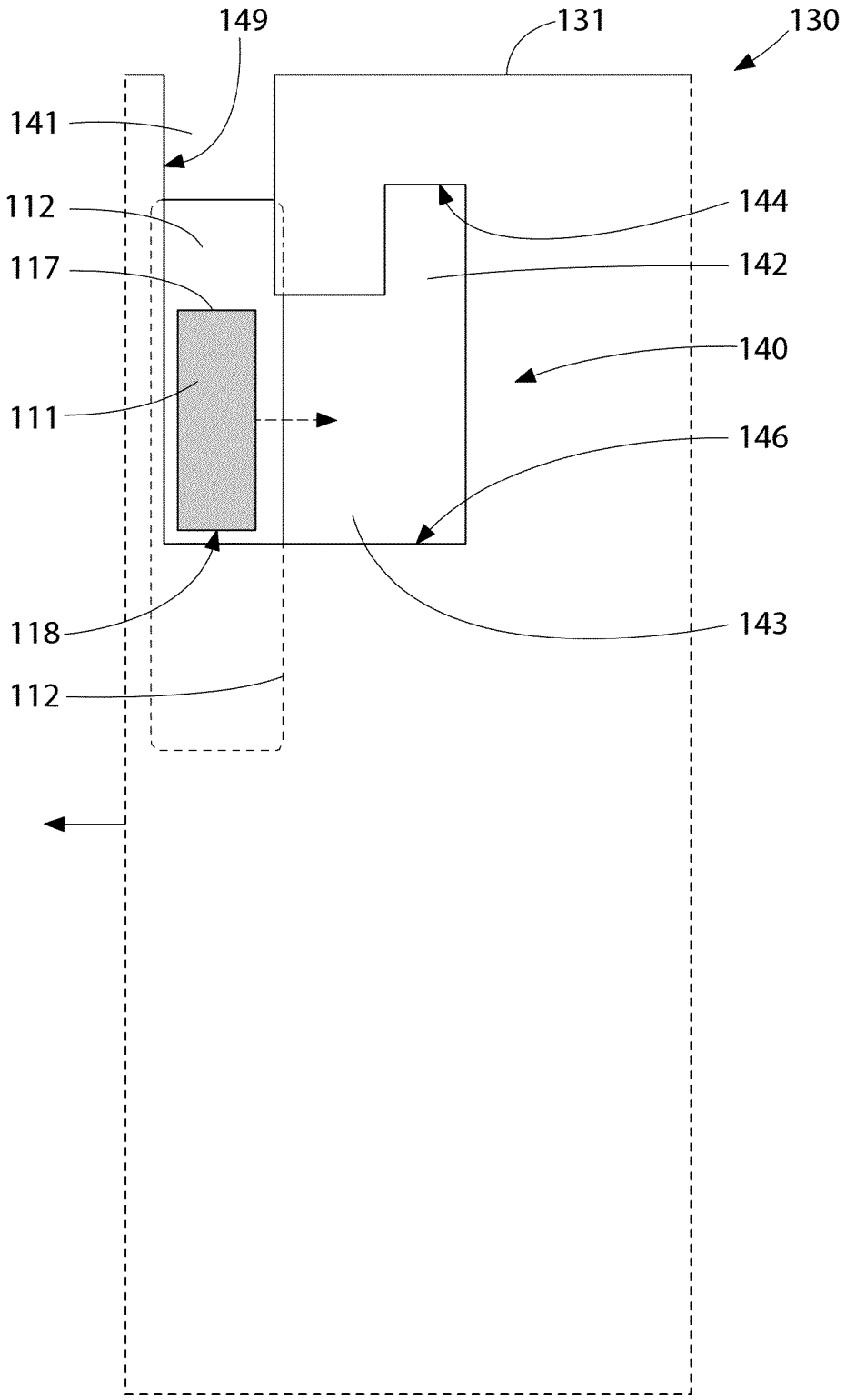

With the panel 130 now in position as shown in FIG. 8A, the panel 130 is raised and moved vertically upwards (see directional motion arrow). Mounting segment 111 of the suspension bar 110 initially enters the top of the slot entrance portion 141, and travels downwards therein as the panel 130 is continued to be raised until the bottom 118 of mounting segment 111 abuttingly contacts bottom surface 146 of the mounting slot 140 (FIG. 8B). The panel 130 cannot be raised any farther and the contact provides a tactile indication to an installer that the mounting segment 111 of the suspension bar 110 has bottomed out in the slot.

Figure 8C:
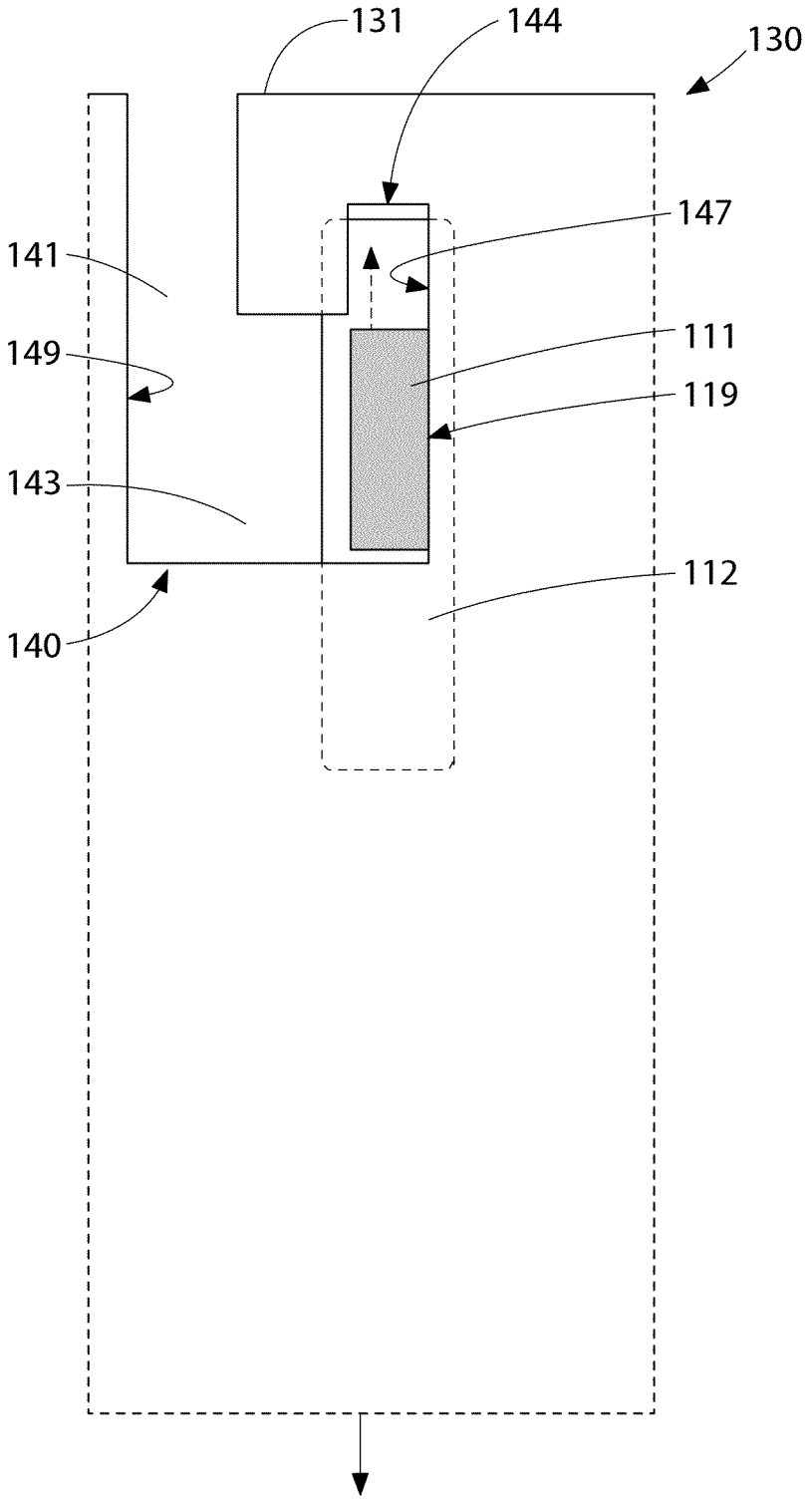

With the panel 130 in the position shown in FIG. 8B adjacent to side surface 149 of mounting slot 140, the panel 130 is next moved laterally (to the left as shown by the directional motion arrow). This concomitantly moves the mounting segment 111 of suspension bar 110 across and through the intermediate portion 143 of mounting slot 140 towards the end portion 142. The side 119 of the mounting segment 111 eventually contacts side surface 147 of the end portion 142 of the mounting slot 140, as shown in FIG. 8C (see also FIG. 7). The contact provides a tactile indication to an installer that the mounting segment 111 of the suspension bar 110 has moved laterally by the maximum extent and is properly positioned in end portion 142 of mounting slot 140 readied for completion of the panel 130 installation. This motion also clears the locking projection 145.

It will be appreciated that the intermediate portion 143 of mounting slot 140 has a height H3 which is at least slightly larger than the height H2 of the mounting segment 111 of suspension bar 110 to permit lateral movement of the mounting section through the slot.

Next, the panel 130 is allowed to drop and vertically lowered with respect to suspension bar 110 (see direction motion arrow). Mounting segment 111 concurrently rises upwards within end portion 142 of mounting slot 140 until the top 117 of the mounting segment contacts and engages stop surface 144 formed at the closed terminal end or top of slot end portion 142 (see FIG. 8D). The panel 130 is now in a fully mounted and seated position locked to suspension bar 110 via an interlock fit. In one embodiment, the top 117 of mounting segment 111 preferably may be vertically positioned above the bottom edge 148 of locking projection 145. This traps the mounting segment 111 in the mounting slot 140 thereby preventing the panel 130 from being moved laterally without raising the panel 130 again. Gravity retains the panel 130 in engagement with the suspension bar 110 via the interlock between the mounting slot 140 and mounting segment 111. The panels 130 may therefore be considered to hook onto the suspension bars 110 for full installation using the combination of vertical and horizontal/lateral movements of the panels 130 with respect to the suspension bars.

To prevent the panel 130 from twisting or rotating when fully mounted on the suspension bar 110, the width W4 of slot end portion 142 is preferably slightly larger than the width W2 of mounting segment 111 by a relatively small margin in one embodiment to promote a tight and secure fit. Accordingly, when fully mounted, the panel 130 the mutual and complementary configuration and dimensions of the slot end portion 142 and mounting segment 111 advantageously prevent the panel 130 from rotating relative to the suspension bar 110. In one embodiment, the slot end portion 142 and mounting segment 111 may each have a rectilinear polygon configuration such as square or rectangular.

In other possible arrangements, mounting segments 111 of the suspension bars 110 may be circular in cross-sectional shape such as for example if a round rod is used for the mounting segments or the entire suspension bar including the mounting segments may have reduced diameters to form grooves 113. In such embodiments, mounting slots 140 in panels 130 may still have rectilinear polygon shapes and the circular mounting segments 111 would travel within the slot in a similar manner described herein to secure the panels 130 to the suspension bars. Accordingly, numerous variations of slots and mounting segments are possible.

Figure 8D:
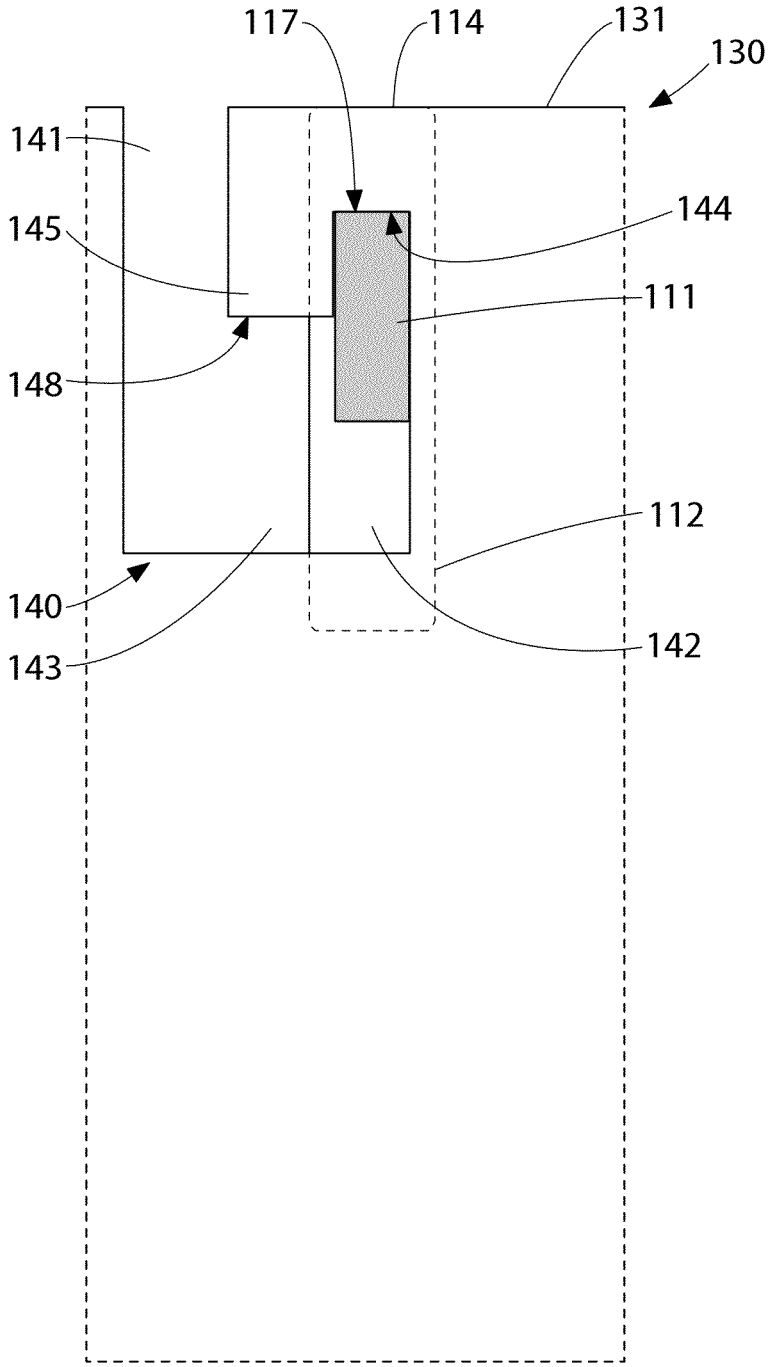

Referring to FIGS. 1 and 8D showing a panel 130 in a fully mounted position on suspension bar 110, it bears noting that portions of the panel 130 immediately adjacent to top 117 and lateral sides 119 of the mounting segment 111 are positioned in the peripheral groove 113 formed between two adjacent (but axially spaced apart) main sections 112 of the suspension bar. This traps the panel 130 between the main sections 112 in the groove 113 which prevents axial tilting of the panel 130 to maintain a vertical orientation perpendicular to the longitudinal axis of the suspension bar in arrangements intended to have vertical panels 130.

Referring to FIGS. 6 and 7, the amount of panel 130 which projects upwards beyond the top 114 of suspension bar 110 may be controlled as desired by adjusting the distance D1 from top 131 of the panel 130 to bottom surface 146 of mounting slot 140 and height H4 of the end locking portion 142 of the slot. In one exemplary embodiment, without limitation, the top 131 of panels 130 may be substantially flush with the top 114 of the main sections 112 of the suspension bar 110 when the panel 130 is fully mounted as shown in FIG. 8D. Other suitable arrangements are possible.

To dismount the panel 130 from the suspension bar 110, the foregoing process is simply reversed allowing for easy removal, maintenance, and or replacement of panels 130 in the baffle system 100.

Advantageously, it should be noted that mounting and removal of the panels 130 to/from suspension bars 110 may be accomplished without additional elements such as mounting brackets or clips which add complexity and cost. The mounting slots 140 are formed directly in the body of the panels 130. In addition, the panel 130 mounting is accomplished without tools. Furthermore, the panel 130 mounting/removal beneficially does not interfere with the suspension system used to support the suspension bars 110 from the ceiling or other overhead superstructure.

Although the foregoing panel 130 mounting process has been described with respect to a single mounting slot 140 of a panel 130 and single suspension bar 110, it will be appreciated that two or more mounting slots 140 and two or more suspension bars 110 may be involved with mounting each panel 130 (see, e.g. FIG. 1). Accordingly, a single panel 130 may be installed on two or more suspension bars 110 by simultaneously performing the foregoing mounting process for each of the mounting slots 140 provided. In some embodiments, at least two mounting slots 140 are provided for each panel 130 to provide two points of securement to at least two suspensions bars 110 of the ceiling baffle system 100. In some examples, for illustration without limitation, a ceiling baffle system 100 having a 6 foot panel 130 may include 3 mounting slots 140 and suspension bars 110, and an 8 foot panel 130 may include 4 mounting slots 140 and suspension bars 110. Any suitable number of panels 130, mounting slots 140, and suspension bars 110 may be used.

Figure 9:
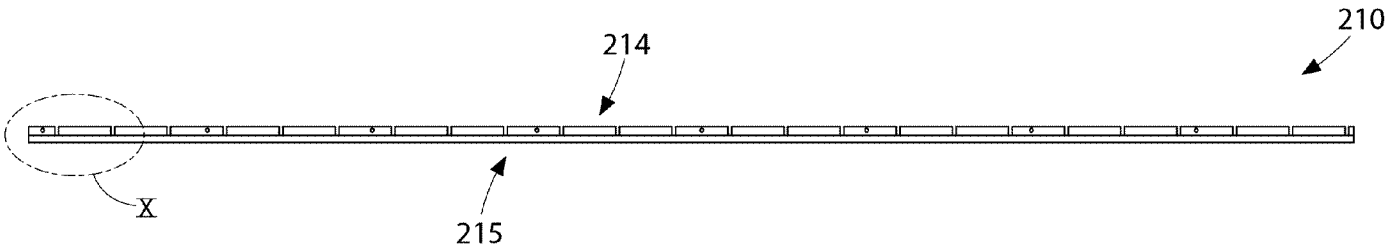
FIG. 9 is a side elevation view of an alternative embodiment of a suspension bar.
Figure 11:
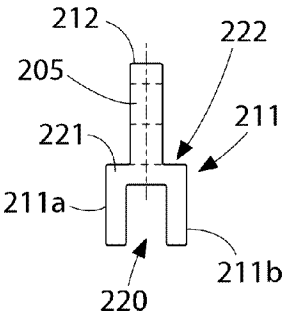
FIG. 11 is a transverse cross-sectional view of the suspension bar taken along line XI-XI in FIG. 9.

It should be noted that panel 130 shown in FIGS. 6-7 and also in FIGS. 4 and 8A-D show two embodiments of mounting slot 140. In FIGS. 6-7, the mounting slot 140 has a substantially uniform spacing (wall-to-wall) along the path traveled by a mounting segment 211 of a suspension bar 210 as shown in FIGS. 9-11 through the entrance, intermediate, and end portions 141, 143, 142 of the slot (see, e.g. width W5, height H3, and width W4 respectively). This spacing would be generally suitable for a mounting segment 211 having a substantially square transverse cross-sectional profile such as that shown in FIGS. 9-11.

By contrast, the mounting slot 140 shown in FIGS. 4 and 8A-D has a non-uniform spacing along the path traveled by the mounting segment 111 through the entrance, intermediate, and end portions 141, 143, 142 of the slot (see, e.g. width W5, height H3, and width W4 respectively). The slot spacing defined by height H3 in intermediate portion 143 is larger than the space defined by widths W5 and W4 of the entrance and end portions 141, 142. This spacing would be generally suitable for a mounting segment 111 of suspension bar 110 having a substantially rectangular transverse cross-sectional profile as shown. It will be appreciated that other suitable slot spacing and configurations are possible which does not limit the invention.

FIGS. 9-12 show an alternative embodiment of a suspension bar 210 which may be used with panel 130 and mounting slot 140. In contrast to suspension bar 110 having a plurality of axially separated and spaced mounting segments 111 (see, e.g. FIG. 2), suspension bar 210 includes a longitudinally extending mounting rail 211 disposed along the bottom 215 of suspension bar 210. In one embodiment, without limitation, mounting rail 211 may be longitudinally continuous extending from end to end of the suspension bar. Mounting rail 211 is configured and dimensioned for insertion into and movement through mounting slots 140 of panels 130 to secure the panels 130 to the suspension bar 210 in a similar manner to suspension bar 110, as already described.

In one embodiment, without limitation, mounting rail 211 includes a base 221 defining a top surface 222 and two laterally/horizontally spaced apart legs 211*a*, 211*b* extending downwards from the base. The bottom surfaces 211*a*, 211*b* define bottom 215 of the mounting rail 211. The gap between the legs 211*a*, 211*b* defines a downwardly open longitudinally extending channel 220 that runs along bottom 215 of the mounting rail 211. Channel 220 may be longitudinally continuous extending from end to end of the mounting rail 211 in some embodiments. In one configuration, without limitation, mounting rail 211 may have a generally inverted U-shape in transverse cross section or profile in which legs 211*a* and 211*b* are arranged substantially parallel to each other on opposite sides of channel 220. The U-shape reduces the weight of suspension bar 210 and provides a certain ornamental appearance. Numerous variations in the configuration of mounting rail 211 are possible similar to mounting segment 111 of suspension bar 110. For example, in some embodiments contemplated, mounting rail 211 may lack separate legs 211*a* and 211*b* and instead be configured as a solid rectilinear polygonal shaped element such as a square or rectangle in transverse cross section.

Referring to FIGS. 9-11, suspension bar 210 further includes an upstanding flange 212 which extends longitudinally along the suspension bar. Flange 212 may be vertically oriented and extends upwards from mounting rail 211. In one embodiment, flange 212 may be attached to or integrally formed with the top surface 222 of the mounting rail base 221. In one embodiment, a plurality of axially spaced mounting holes 205 may be formed laterally through flange 212 for hanging the suspension bar 210 from the ceiling or other overhead superstructure via cables, wires, rod hangers, or similar coupled through the holes.

Flange 212 may further include a plurality of vertically oriented slots 223 which provide mounting locations for panels 130. Slots 223 are axially spaced along the length of flange 212 at locations which panels 130 are desired. Slots 223 may extend through and from top 214 of suspension bar 210 in the flange 212 down to top surface 222 of mounting rail 211 in one embodiment, as best shown in FIG. 10. This completely exposes the top surface 222 of mounting rails 211 within the slots 223 so that the stop surface 144 formed in the mounting slot 140 of the panel 130 may fully and squarely engage the base 221 of the mounting rail 211. Accordingly, the combination of the slot 223 and portion of the base 221 exposed within the slot defines mounting segments in this embodiment of a suspension bar 210 similar to exposed mounting segments 111 of suspension bar 110 shown in FIGS. 1-3.

In one configuration, slots 223 may have a rectilinear polygonal shape. Numerous variations in shape, however, are possible.

In embodiments where panels 130 are intended to be vertically oriented when mounted to suspension bar 210, slots 223 may be vertically oriented. In other possible embodiments, slots 223 may optionally be slanted or angled with respect to top surface 222 of mounting rail 211 (shown in dashed lines) where panels 130 are intended to be angle mounted for effect on the suspension bar 210. In some arrangements, a combination of vertically straight and slanted/angled slots 223 may be provided on a single suspension bar 210.

Slots 223 perform a similar function to grooves 113 in suspension bar 110 allowing a portion of the panel 130 to be received in the slot 223 for accessing panel mounting slot 140 with the mounting rail 211 to couple the panel 130 to the suspension bar. Accordingly, each slot 223 has an axial width which is large enough to receive a portion of panel 130 in the slot (see, e.g. FIG. 12). Flange 212 may have a suitable height to provide secure mounting of the panel 130 to the suspension bar 210 via the slot 223 so that the panel 130 does not excessively wobble or tilt in an axial direction.

Figure 12:
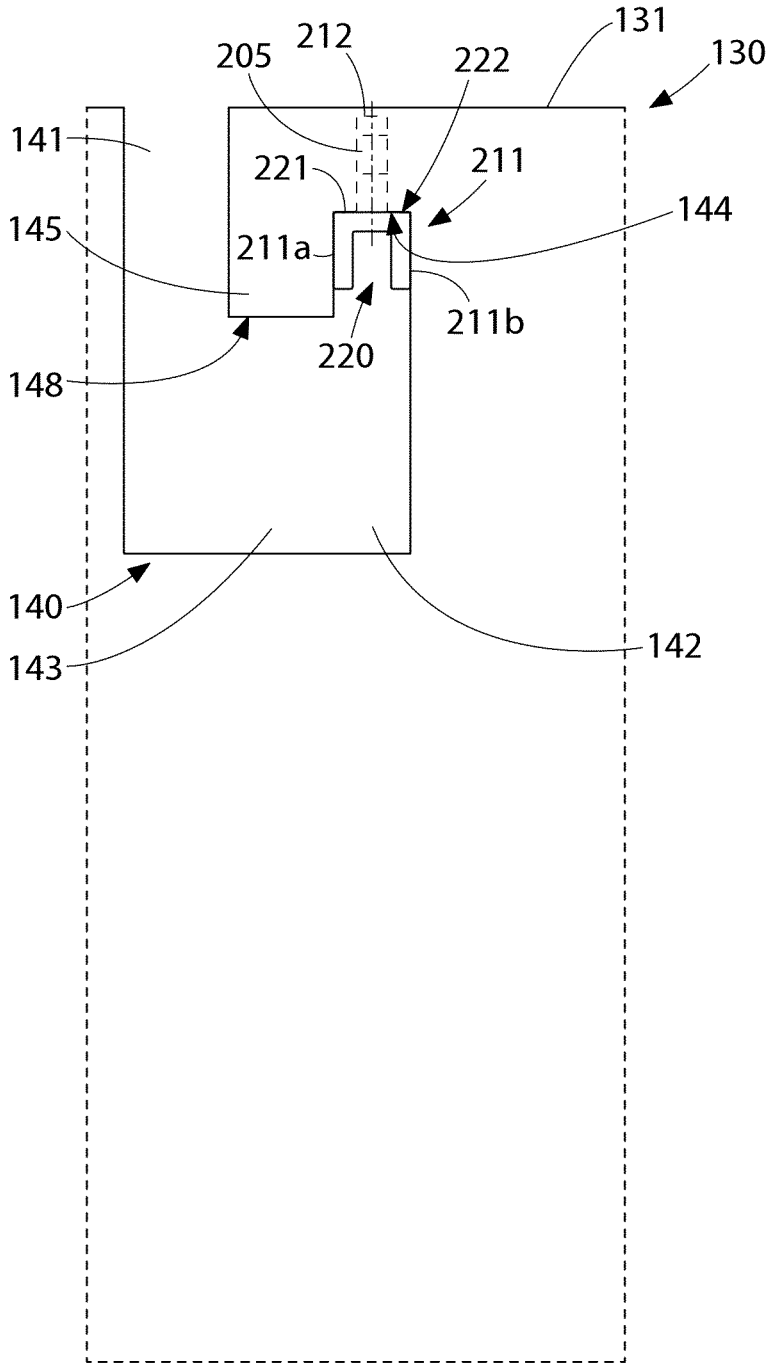
FIG. 12 is a transverse cross-sectional view of the suspension bar of FIG. 9 with a panel mounted thereon.

FIG. 12 shows a panel 130 fully mounted to suspension bar 210 using mounting slot 140. As shown in FIG. 12, top surface 222 of mounting rail 211 is engaged with stop surface 144 of the panel 130 within the mounting slot 140. Mounting rail 211 is configured and dimensioned for insertion into and movement through panel mounting slot 140. The panel 130 is mounted in a similar sequence of steps as the process shown in FIGS. 8A-D and already described herein in conjunction with suspension bar 110.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling-mounted vertical baffle system comprising:

an overhead ceiling support structure;

a longitudinally-extending suspension bar mounted from the ceiling support structure in a suspended manner and having a first height, the suspension bar including a longitudinal axis, a main section having a first transverse profile and a first width measured transversely to the longitudinal axis, and a plurality of mounting segments spaced axially apart along a length of the suspension bar, the mounting segments having a reduced second transverse profile which is less than the first transverse profile of the main section, wherein the mounting segments have a second width measured transversely to the longitudinal axis less than the first width of the main section forming peripheral grooves on opposite lateral sides of the bar at each mounting segment; and a vertical panel mountable to the suspension bar and having a second height, the panel including an upper hook element disposed proximate to a top of the panel, the hook element being configured to detachably engage a mounting segment of the suspension bar to secure the panel to the suspension bar;

wherein the first height of the suspension bar is less than the second height of the panel.

2. The baffle system of claim 1, wherein the hook element comprises a locking projection formed as an integral unitary part of the panel and extending downwardly from the top of the panel.

3. The baffle system of claim 1, further comprising a mounting slot formed integrally in the panel and cooperating with the hook element to secure the panel to the suspension bar.

4. The baffle system of claim 3, wherein the slot is configured and arranged in the panel to circumscribe the hook element.

5. The baffle system of claim 3, wherein the slot further comprises:

a vertically extending entrance portion disposed on one side of the hook element which penetrates the top of the panel, the mounting segment being insertable into the entrance portion through the top of the panel; and a vertically extending end portion disposed on an opposing side of the hook element which does not penetrate the top of the panel, the end portion defining a stop surface configured to engage the mounting segment of the suspension bar when the panel is fully mounted to the suspension bar.

6. The baffle system of claim 5, wherein the slot further comprises horizontal intermediate portion disposed below the hook element and communicating with the entrance and end portions of the slot, the mounting segment of the suspension bar being laterally moveable from the entrance portion of the slot to the end portion of the slot through the intermediate portion.

7. The baffle system of claim 6, wherein the mounting slot is generally J-shaped.

8. The baffle system of claim 1, wherein the mounting segments have a reduced profile in transverse cross-section in relation to adjacent sections of the suspension bar.

9. The baffle system of claim 8, wherein each mounting segment has an associated groove configured to receive a portion of the panel therein when the panel is mounted to the suspension bar.

10. The baffle system of claim 9, wherein the groove extends completely around the mounting segment.

11. The baffle system of claim 1, wherein the mounting segments have a rectilinear polygonal shape in transverse cross section.

12. A ceiling-mounted baffle system comprising:

an overhead ceiling support structure;

a plurality of longitudinally-extending suspension bars mounted from the ceiling support structure in a suspended manner and each having a first height, each suspension bar including a longitudinal axis, a main section having a first transverse profile and a first width measured transversely to the longitudinal axis, and a plurality of peripheral grooves defining mounting segments spaced axially apart along a length of the suspension bar, the mounting segments having a reduced second transverse profile which is less than the first transverse profile of the main section, the peripheral grooves formed on opposite lateral sides of each bar at each mounting segment, wherein the mounting segments have a second width measured transversely to the longitudinal axis less than the first width of the main section; and a plurality of vertical panels mountable to the suspension bars and each having a second height, each panel including a recurving-shaped mounting slot configured to receive a mounting segment of a suspension bar;

wherein each panel is mounted to a suspension bar by moving a mounting segment in opposing vertical directions within different portions of the mounting slot to secure the panel to the suspension bar.

13. The baffle system of claim 12, wherein the mounting slot is formed integrally with the panel.

14. The baffle system of claim 12, wherein the mounting slot is disposed proximate to a top of the panel.

15. The baffle system of claim 12, wherein the mounting slot includes a vertically elongated entrance portion penetrating a top of the panel to form an opening, a vertically elongated end portion having a closed end, and an intermediate portion laterally connecting the entrance and end portions.

16. The baffle system of claim 15, wherein a mounting segment of a suspension bar is laterally movable through the intermediate portion of the slot from the entrance portion to the end portion without tilting the panel.

17. A ceiling-mounted vertical baffle system comprising:

an overhead ceiling support structure;

a longitudinally-extending suspension bar mounted from the ceiling support structure in a suspended manner, the suspension bar including a longitudinal axis, a main section having a first transverse profile and a first width measured transversely to the longitudinal axis, and a plurality of mounting segments spaced axially apart along a length of the suspension bar, the mounting segments having a reduced second transverse profile which is less than the first transverse profile of the main section, wherein the mounting segments have a second width measured transversely to the longitudinal axis less than the first width of the main section forming peripheral grooves on opposite lateral sides of the bar at each mounting segment; and a vertical panel mountable to the suspension bar, the panel including an upper hook element disposed proximate to a top of the panel, the hook element being configured to detachably engage a mounting segment of the suspension bar to secure the panel to the suspension bar;

wherein the suspension bar has a different configuration than the panel.

* * * * *